United States Patent [19]

Rias

[11] Patent Number: 4,535,587

[45] Date of Patent: Aug. 20, 1985

[54] MULTI-ROLL PACKAGE OF COMPRESSIBLE MATERIALS

[75] Inventor: Jean-Claude Rias, Villennes-sur-Seine, France

[73] Assignee: Isover Saint-Gobain, Neuilly-sur-Seine, France

[21] Appl. No.: 525,796

[22] Filed: Aug. 23, 1983

Related U.S. Application Data

[63] Continuation of Ser. No. 250,700, Apr. 2, 1981, abandoned, which is a continuation-in-part of Ser. No. 217,001, filed as PCT FR80/00116, Jul. 9, 1980, published as WO81/00091, Jan. 22, 1981, § 102(e) date Mar. 9, 1981, abandoned.

[30] Foreign Application Priority Data

Jul. 9, 1979 [FR] France ..... 79 17771
Oct. 10, 1980 [FR] France ..... 80 21735

[51] Int. Cl.[3] ..... B65B 13/20; B65B 53/06; B65B 63/02

[52] U.S. Cl. ..... 53/436; 53/442; 53/447; 53/449

[58] Field of Search ..... 53/436, 442, 444, 447, 53/449, 528, 592

[56] References Cited

U.S. PATENT DOCUMENTS

| | | | |
|---|---|---|---|
| 1,752,404 | 3/1976 | Adamson | 206/417 |
| 3,111,221 | 11/1963 | Chapman et al. | 53/442 X |
| 3,272,329 | 9/1966 | Mehalov | 206/65 |
| 3,288,311 | 11/1966 | Beattie | 206/443 |
| 3,324,625 | 6/1967 | Dulmage | 53/442 |
| 3,407,562 | 10/1968 | Di Nicola | 53/436 |
| 3,587,201 | 6/1971 | Strayer | 53/24 |
| 3,638,790 | 2/1972 | Schmid et al. | 206/65 S |
| 3,640,048 | 2/1972 | Zelnick et al. | 53/442 |
| 3,739,544 | 6/1973 | Hanemann | 53/442 X |
| 3,764,351 | 10/1975 | Whittington et al. | 206/443 |
| 3,825,113 | 7/1974 | Kramer et al. | 53/442 X |
| 3,853,218 | 12/1974 | Grasvoll | 53/442 X |
| 3,855,756 | 12/1974 | Sweeney et al. | 53/442 |
| 3,858,526 | 1/1975 | Lombard et al. | 53/442 X |
| 3,895,476 | 7/1975 | Burns; III | 53/442 |
| 4,036,364 | 7/1977 | Ambrose | 206/526 |
| 4,195,732 | 4/1980 | Bell | 206/597 |
| 4,224,780 | 9/1980 | Rewitzer | 53/436 |
| 4,289,236 | 9/1981 | Ganz et al. | 53/442 X |

FOREIGN PATENT DOCUMENTS

| | | | |
|---|---|---|---|
| 519119 | 4/1929 | Fed. Rep. of Germany | 200/443 |
| 2631817 | 1/1978 | Fed. Rep. of Germany . | |
| 1579675 | 8/1969 | France . | |
| 2188572 | 1/1974 | France . | |
| 2216811 | 8/1974 | France . | |
| 2437994 | 4/1980 | France . | |

*Primary Examiner*—Horace M. Culver
*Attorney, Agent, or Firm*—John T. Synnestvedt; Kenneth P. Synnestvedt

[57] ABSTRACT

Method is disclosed for packaging rolls of compressible insulation, including partially compressing a multi roll assembly of rolls superimposed upon each other between upper and lower contoured panels, while restraining lateral spreading of the assembly of rolls, and thereby establish predetermined package dimensions in both directions transversely of the rolls. There is also disclosed a method for stacking and interconnecting a plurality of the partially compressed multi roll packages.

7 Claims, 13 Drawing Figures

FIG. 6.
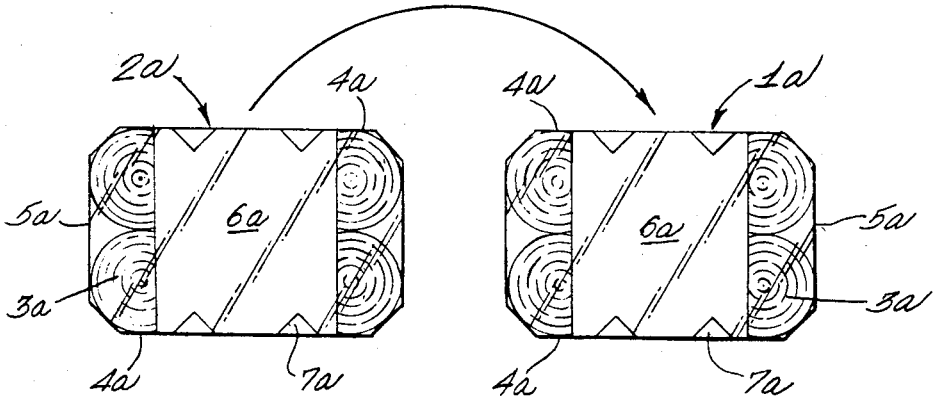
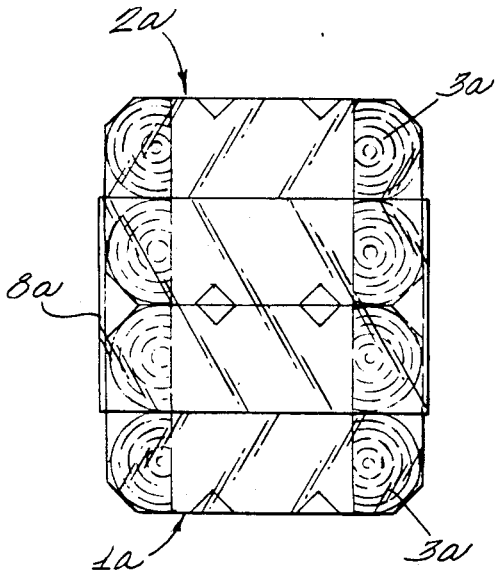
FIG. 7.
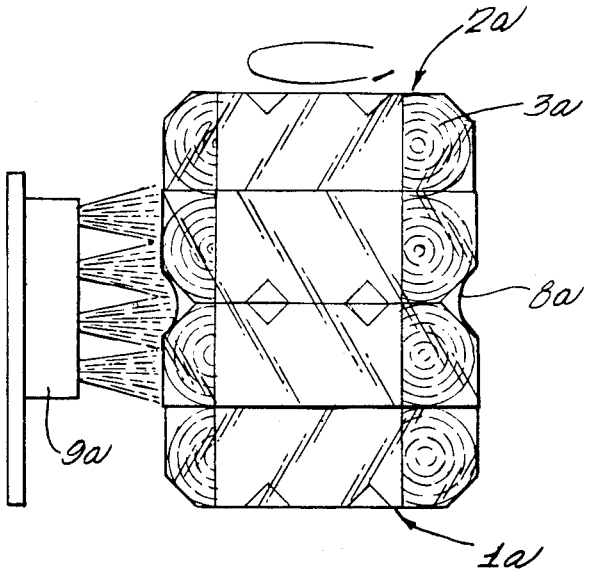
FIG. 8.

FIG. 9.
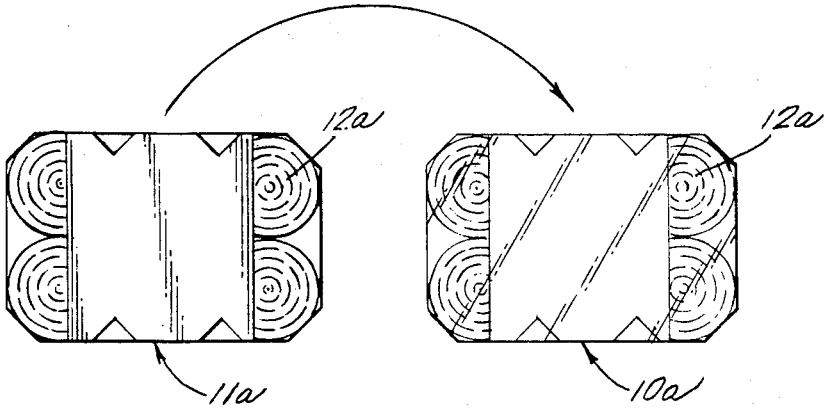
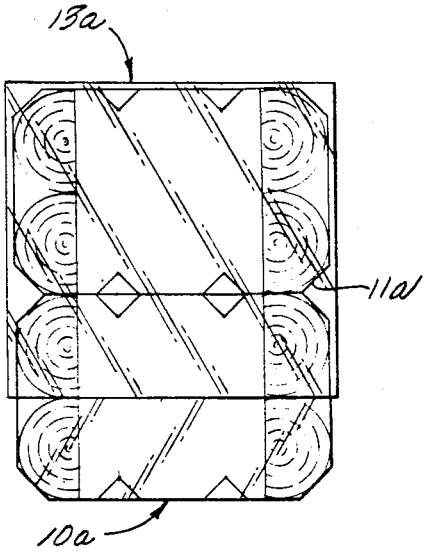
FIG. 10.
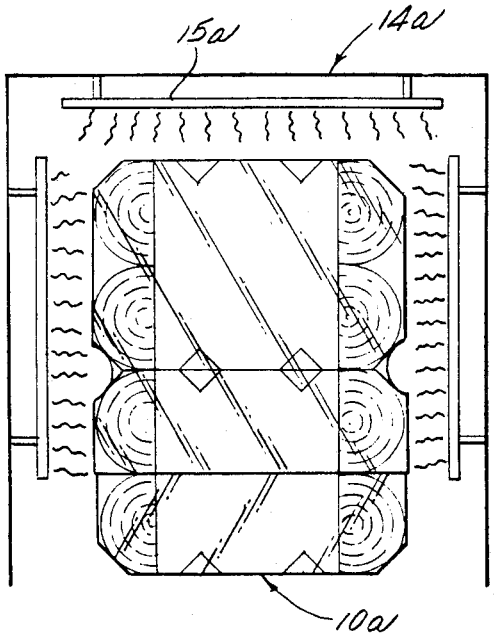
FIG. 11.

MULTI-ROLL PACKAGE OF COMPRESSIBLE MATERIALS

This application is a continuation of application Serial No. 250,700, filed Aug. 2, 1981, now abandoned, which was a continuation-in-part of application Serial No. 217,001, filed as PCT FR80/00116, Jul. 9, 1980, published as WO81/00091, Jan. 22, 1981, § 102(e) date March 9, 1981, now abandoned.

The present invention relates to an improved multiple roll package of compressible material such as fibrous insulating material and also to a process and apparatus for forming packages of such compressible materials.

Various packagings of rolled materials, which may be employed either with individual rolls or with rolls assembled side by side, are known. The packaging in these various known cases is generally made up of one or several sheets of paper folded down on the ends of the roll or of the assembly, or made up of sheets of plastic material of the polyethylene type, usually shrunk by thermal treatment. These various types of packaging units are no longer suitable for satisfactorily responding to the needs of the users in the construction field, since very large quantities of products are frequently required to be transported from the production plant to the points of use.

In the case of light materials, such as insulating materials, the necessary volume of such materials in storage can reach a third of the total storage volume of the construction materials handled by the users. Up to now, the technique of palettization resolved the problems posed by the handling of heavy materials, such as bricks, cement, etc. . . , however the use of returnable palettes, and also the use of returnable containers involves the problem of recovery of the palettes with risks of damage to the palettes, and with resulting division of responsibility. This system has not been used up to now for light materials.

As far as rolls of light materials are concerned, the solution proposed for handling such materials was to group several dozen roll units, such as the individual insulating rolls above referred to, so as to make up a package, for example of generally cubical shape, capable of exceeding the volume of 15 $m^3$, and a weight of several hundred kilos. However, this volume and weight makes the handling of such packages difficult, unless specific and expensive handling means are used at the production plant, in the storage warehouses and at the premises where the materials are used. Because of these factors, handling means, such as cranes or lifts, are indispensable for accomplishing the handling, and this generally leads to expensive investments. Furthermore, the size of these rolls is such that they cannot be stored in ordinary warehouses, which very often are equipped with bins, racks or attics of insufficient dimensions.

Such voluminous rolls could also be stored in the open. However, they would then have to be water and air tight and weather resistant (frost, rain and sunning), which would increase their cost prohibitively.

It has also been proposed to produce packages in which elastic insulating products are collected in compressed form. Packages of this type are known, in which compressed, fibrous, insulating panels are stacked one on top of the other (French Pat. No. 2,216,811). Other packages of this type contain tubular, fibrous products, such as insulating ducts or pipes, stacked in the flattened state (U.S. Pat. No. 3,587,201). Such modes of packaging are not useable with insulating materials of the kind mentioned, due to the fact that these materials cannot be reduced to such a state of compression without adverse effects.

The aim of the invention is to overcome these disadvantages by providing a new type of multi-roll package of a compressible material, in particular insulating rolls, in which the compressible material is only subjected to a limited compression, in order to avoid its permanent deformation, and which lends to the handling of the packages by conventional apparatus such as fork lifts, and which packages can be stacked for storage.

For these purposes, one object of the invention is to provide a package of at least two layers of rolls of a compressible material, the rolls of each layer being placed side by side and in mutual contact, while lower and upper rolls of two superposed layers vertically overlie each other and are in mutual contact along their lowermost and uppermost surfaces, this package being characterized in that it contains:

- two contoured or grooved panels adjacent the outer sides of the layers of the rolls, and
- two bindings bearing on the contoured panels and orthogonally arranged with respect to each other.

Preferably, a covering of paper or of stretchable or shrinkable plastic material will envelope the rolls, the panels and the bindings, to protect the unit from inclemencies and to improve the overall form of the package.

Advantageously, the grooves of the said panels will receive and position the rolls and the panels will be joined by transverse panels at the ends of the rolls to form one of said bindings, whereas plastic bands or strips will make up the second bindings, perpendicular to the first bindings.

According to another important characteristic of the invention, the contoured panels at two opposite sides of the package will each have two recesses lying between the grooves, said recesses accommodating the fork of a handling apparatus, these recesses resulting from folding or casting of the material of which these panels are composed. The transverse panels at the ends of the rolls preferably have perforations to accommodate said fork, or will have definitely marked areas which the fork will perforate during the handling of the package.

It is also an object of the invention to provide a process of making such a package, characterized in that:

- a first layer of rolls arranged side by side and in mutual contact is placed on a grooved panel;
- at least one other layer of rolls formed like the first layer is stacked on the first layer, the rolls of the second layer being in contact along their lowermost surfaces with the uppermost surfaces of the rolls of the first layer;
- a second grooved panel is placed on the stack and the stack is compressed between the two grooved panels; and
- the stack maintained in the compressed state is bound with binding elements bearing on said panels and forming two bindings orthogonally directed in relation to each other.

Preferably, the assembly thus formed is next enveloped with a paper covering or with stretchable or shrinkable plastic material.

A further object of the invention is to provide an apparatus for implementing the process, this apparatus being characterized in that it contains:

- a base for the lower grooved panel and the stack of multi-roll layers;

an upper plate, which is movable with respect to the base under the influence of the compression means used; and side supports constituting a structure defining a maximum package size.

Said base will preferably contain individual supports for the rolls of the first layer, said individual supports being adjustable in position with regard to each other, so that they may be positioned beneath the base of the grooves of the overlying contoured panel when rolls of different sizes are being packaged. These supports will preferably have a cross section having the contour of the roll surfaces.

The side supports, which define the maximum structure, will preferably be adjustable in position with regard to each other. Advantageously, these supports will contain openings to accommodate strips or similar binding elements.

Another object of the invention is constituted by the application of said packages to the storage of rolls of compressible materials, by stacking said packages in piles containing a plurality of the packages.

Still another object of the invention is to provide for binding together a group of multiple roll packages particularly of the kind described above in a manner further simplifying handling and storage of such insulation rolls in total quantities larger than included in the individual multiple roll packages.

The attached drawings illustrate the implementation of the invention. On these drawings:

FIGS. 6, 7 and 8 illustrate different phases of the assembly of a stack of multiple roll packages in the case where the package assembling means is a belt of shrinkable material, these figures respectively show stacking, placement of the belt and shrink fit of the latter;

FIGS. 9, 10 and 11 are views similar to FIGS. 6, 7 and 8, illustrating a modified form of the assembling and wrapping of a stack of packages with shrinkable material;

Figure 1:
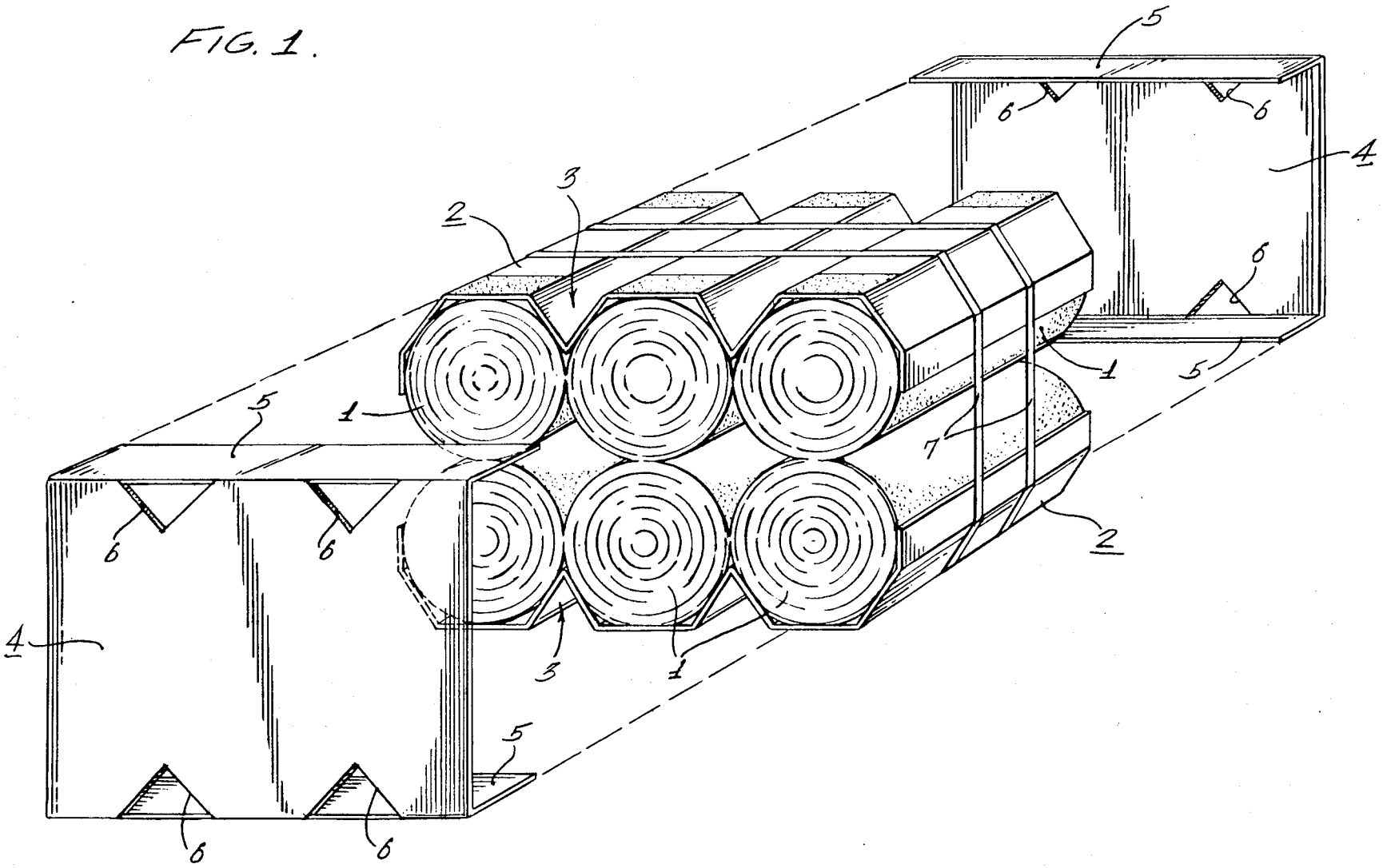
FIG. 1 is an exploded view in perspective of a package of six rolls.
Figure 2:
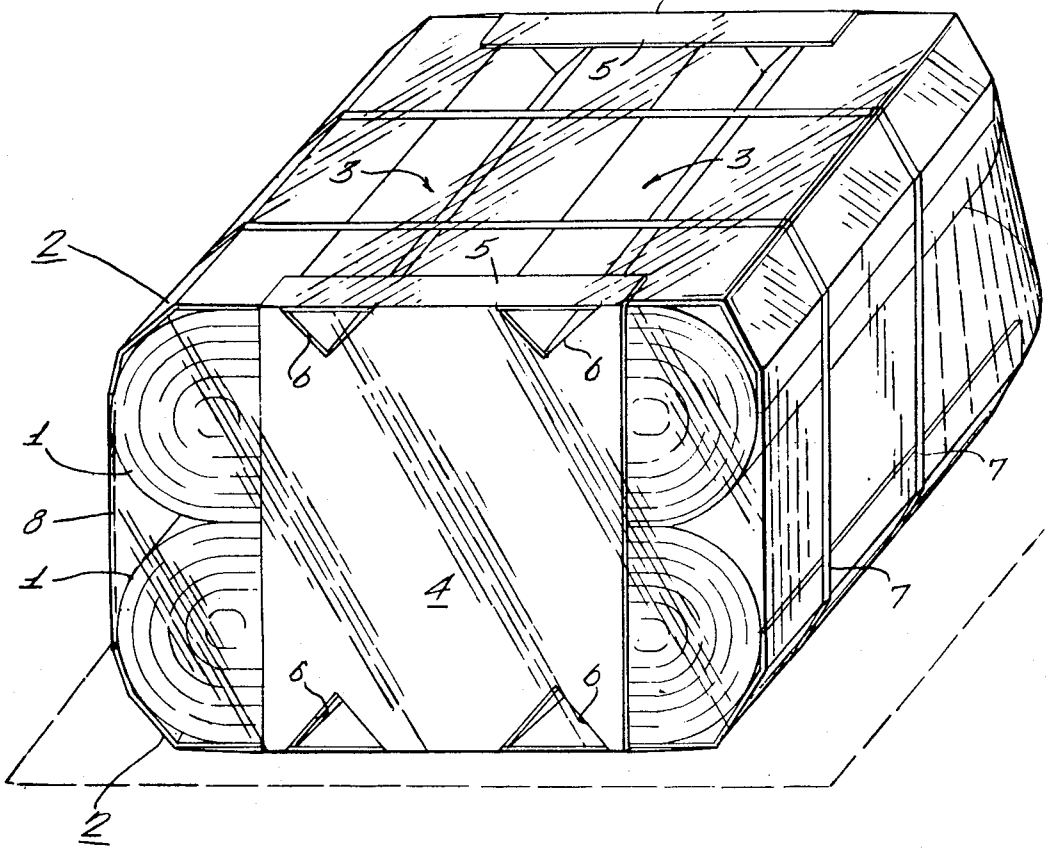
FIG. 2 is a view in perspective of an assembled package of the kind shown in FIG. 1.

The package in accordance with the invention, in the embodiment shown in FIGS. 1 and 2, is made up of six rolls 1 of a compressible material, for example, a fibrous thermal insulating material, such as glass fibers. These rolls are grouped in two superimposed layers each containing three rolls, the rolls of the lower layer being placed parallel and in mutual contact, whereas the rolls of the upper layer rest on the rolls of the lower layer with the uppermost and lowermost surfaces in contact.

The rolls of the lower layer are supported by a panel 2 cast of a plastic material or formed of cardboard, which is contoured or grooved to receive the lower portions of rolls 1 and provide triangular recesses 3 at the underside to receive the fork prongs of a fork lift or handling apparatus.

Analogously, an identical panel 2 overlies the rolls of the upper layer, the upper panel being inverted in position as compared with the bottom panel.

End panels 4, also of plastic material or of cardboard, are placed against the ends of the rolls 1 and are bonded to the panels 2 by flanges 5 glued to the panels 2. These panels 2 and the panels 4 thus form a first binding enclosing the rolls 1. The panels 4 contain cut-outs 6 in registry with recesses 3 of the contoured panels 2, in order to accommodate the teeth of a fork lift.

A second binding, orthogonal to the one first described, is formed by one or more strips 7, preferably at least two strips, of plastic material, for example of polypropylene, which surround the rolls 1 and panels 2 perpendicular to their axes.

Finally, a covering 8 of a shrinkable material, for example polyethylene of a thickness of from 0.07 mm to 0.15 mm, encloses the assembly formed by the rolls 1, the contoured panels 2, the panels 4 and the strips 7.

The binding formed by the panels 2 and the panels 4 establish the height of the assembly of rolls 1 and prevent lateral deformation, whereas the encircling strips 7 prevent the longitudinal sliding of the rolls. The covering 8 of shrinkable material protects the package from inclemencies.

Figure 3:
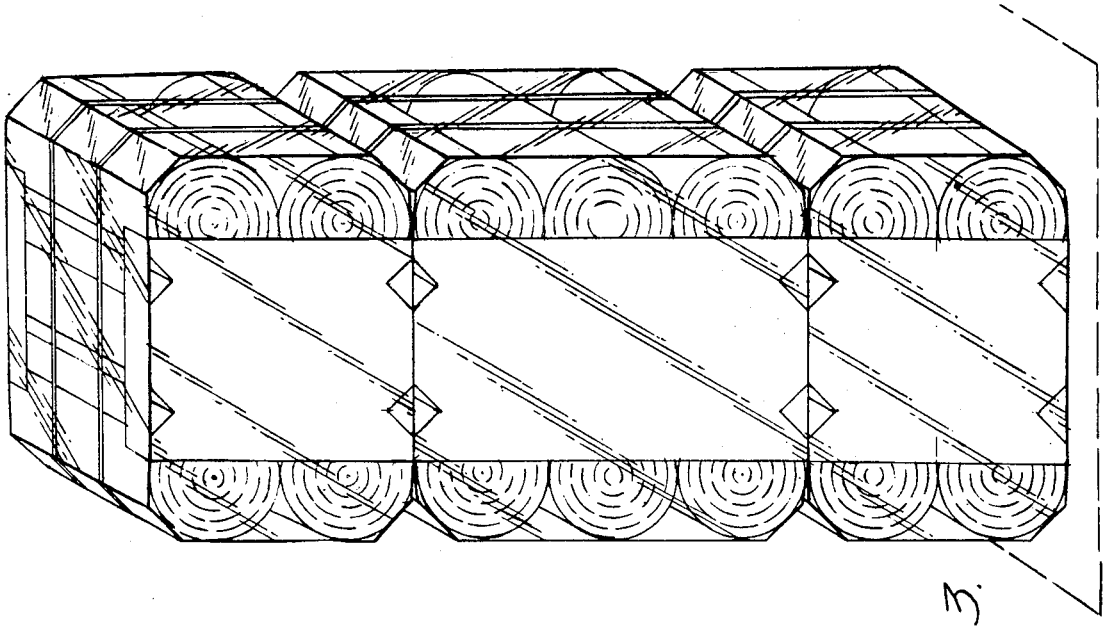
FIG. 3 illustrates the stacking of a plurality of packages of six and nine rolls.

For the handling of such a package with a fork lift, the teeth of the fork may readily perforate the covering 8 and engage in the cut-outs 6 of the panels 4 and the recesses 3 of the panels 2. The accessibility of the recesses for cooperation with the fork elements of a fork lift is thus maintained. It is also possible to easily stack several packages, identical or not, on top of each other, as is seen in FIG. 3. Packages of six or nine rolls, or even more, can be formed. For instance, FIG. 3 shows a stack of packages of six and nine rolls.

The applicant has thus provided packages of rolls of fibrous thermal insulating material, which in typical cases have the following characteristics:

Packages of six rolls:
diameter of the rolls: 500 to 550 millimeters,
length of the package: 1600 mm,
width: (length of the rolls): 1200 mm,
height of the package: 860 mm,
weight of the package: about 95 kg.

Three packages of this type can be stacked, totalling 18 rolls.

Packages of nine rolls:
diameter of the rolls: 500 to 550 millimeters,
length of the package: 1600 mm,
width: (length of the rolls): 1200 mm,
height of the package: 1280 mm,
weight of the package: about 145 kg.

Two packages of this type can be stacked, totalling 18 rolls, as in the preceding case.

In practice, to reduce the volume of the package and to increase its mechanical endurance, the rolls 1 are compressed under a pressure lower than that which would cause their permanent deformation, before being assembled by the orthogonal bindings.

In the case of thermal insulation rolls, the characteristics of which were just given, these rolls are, in general, compressed so as to cause a reduction of their diameter of 10 to 25%, which corresponds to a pressure of 1000 to 2200 Pascal. For instance, a pressure of 1550 Pascal (corresponding to a stress of 250 kg) causes a diameter reduction of 17%.

Figure 5:
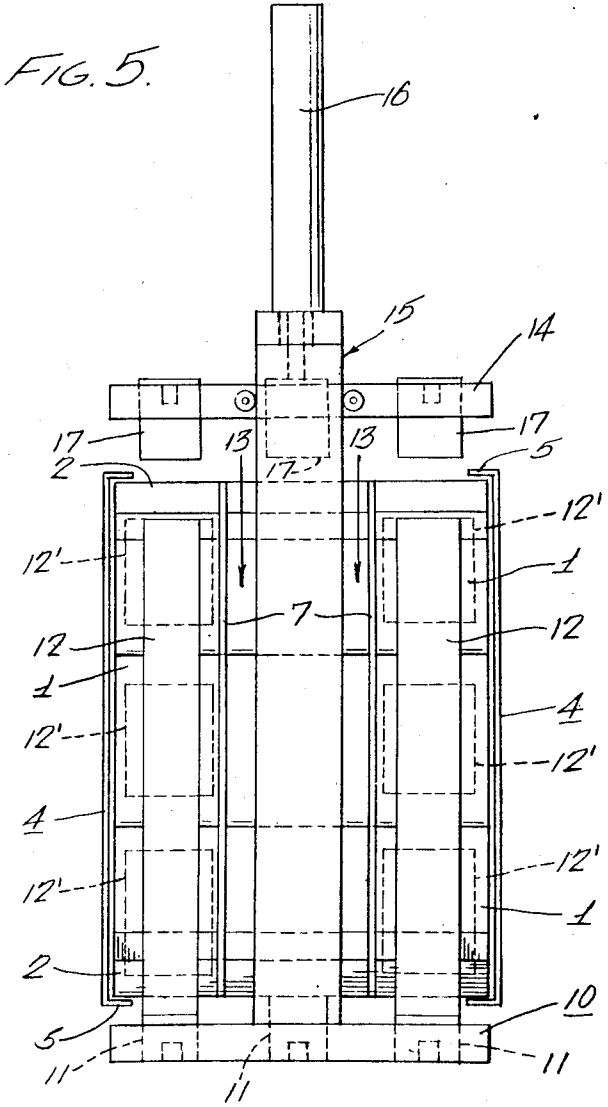
FIGS. 4 and 5 are two elevational views, one from the front and the other from the side, of an apparatus for use in assembling and binding the multiple roll packages.
Figure 4:
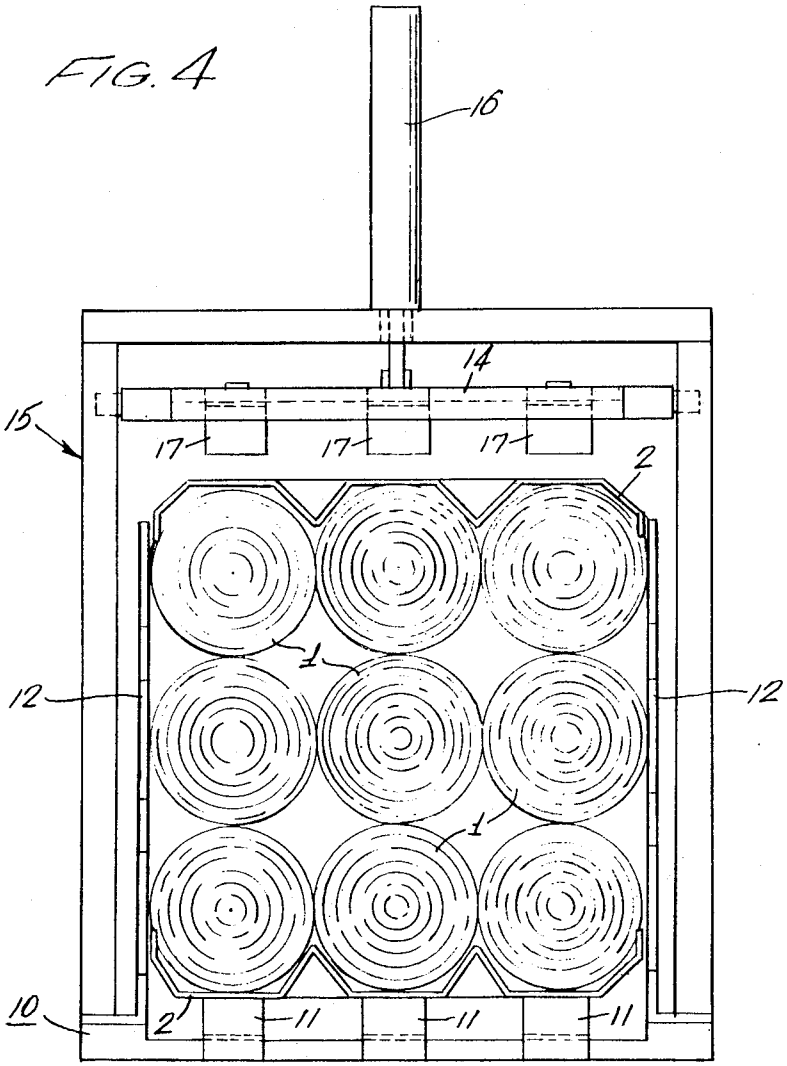
Figure 12:
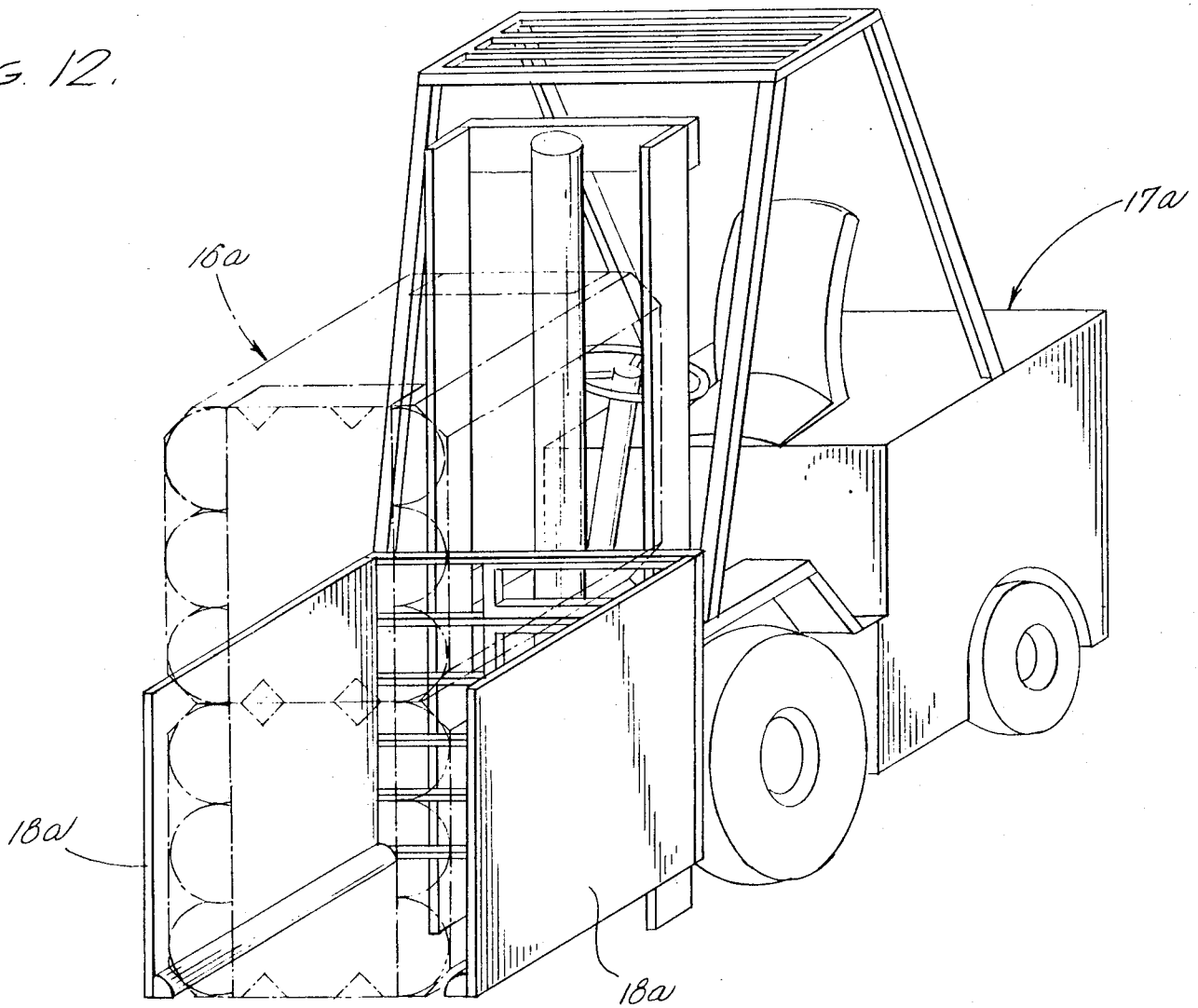
FIG. 12 shows a two-package stack being transported by a carrier vehicle.

In order to produce the packages according to the invention and to compress the multi-roll packages, the apparatus schematically shown in FIGS. 4 and 5 will be advantageously utilized.

This apparatus has a base 10, equipped with supports 11 laterally adjustable in position to accommodate rolls of different sizes, side walls formed by vertical plates 12, or preferably of plates 12' shown as broken lines in FIG. 5 separated by gaps 13, and an upper plate 14, parallel to the base 10 and capable of being displaced with regard to the latter on a frame 15 under the effect of a jack 16. The plate 14 is equipped with pressure blocks 17 for engaging and compressing the rolls being packaged.

A panel 2, previously contoured, is placed on the supports 11, of which the position was adjusted so that each of the supports was aligned with a roll 1. The various layers of rolls are stacked and the last one is covered with a grooved panel 2, identical to the panel first mentioned but arranged in inverted position. With plate 14 and panel 15 the multi-roll parcel is then lightly compressed to the desired volume and the plate 14 is maintained in this position.

Strips 7 are then applied by introducing these strips through the spaces 13 which separate the plates 12. Finally, the flanges 5 of the panels 4 are glued on the ends of the lower and upper panels 2. This gluing can alternatively be effected before the encircling of the rolls by the strips 7.

The multi-roll package is then withdrawn from the compression apparatus and it is enveloped with a shrinkable polyethylene covering 8, before passing the unit into a shrinking oven.

Because of the compression of the rolls during packaging, the contoured panels 2 and the panels 4 work in tension when the pressure exerted during the formation of the package is relieved; and at the same time, a stiffening effect is exerted by the panels 4 on the stack. This precompression also makes the panels 2 and the panels 4 particularly suitable to resist compression when the packages are stacked and support the weight of other packages.

The invention, therefore, proposes a particularly simple process for the formation of multi-roll packages of a compressible material, thermal insulation rolls in particular, which favors the handling and storage of these packages without it being necessary to resort to palettes and to large storage areas.

It should be noted that it is easy, for the user, to remove the rolls from the packages just described and that the constituent materials of these packages are not very voluminous, are inexpensive and are easily destroyed after utilization.

The process according to the invention is transposable to articles of compressible material not being in the form of rolls, for example to substantially parallelepipedal blocks of plastic foam material, or even to packets of thermal insulating materials, provided that the form of these articles enables the use of the contoured outer panels, having recesses for the teeth of a fork of a handling apparatus. Such an adaptation of this process is within the scope of the present invention.

Turning now to FIGS. 6 to 13, it is first noted that the multiple roll packages shown are of the kind and configuration of the packages of FIGS. 1 to 5, but here provision is made for stacking and assembling the multiple roll packages into larger assemblies.

In FIGS. 6 to 8, both packages shown are covered with a protective wrapping. Package 2*a* is first stacked on top of package 1*a*, then a belt 8*a* of shrinkable material is wrapped horizontally around the pile of packages (FIG. 7), so as to laterally encircle the lower part of the upper package 2*a* and the upper part of the lower package 1*a*. Preferably, as shown in the drawings, the belt 8*a* will be positioned symmetrically with respect to the contacting portions of the two packages and will encircle each over a distance at least equal to the diameter of the individual rolls 3*a*. Belt 8*a* will, for example, be made of a film of polyethylene extended only in a direction perpendicular to the direction of stacking of the packages in order to reinforce its resistance to stretching. This film of polyethylene will have a thickness of 100 microns, for example.

The belt 8*a* of shrinkable material is then brought to a temperature sufficient to produce shrinkage, for example as shown in FIG. 8, by moving the stack of packages in front of a manifold 9*a* of hot air nozzles which discharge hot air in the direction of the stack and by turning the stack in front of the manifold 9*a* (FIG. 8). Under the influence of heat, the belt 8*a* shrinks and shrink fits over the packages 1*a* and 2*a* at the point where they interfere, thereby assembling them to form one stack whose handling, as will be shown hereinafter, is easy and which may be delivered to users in this form.

In FIGS. 9, 10 and 11, the stacks 10*a* and 11*a* are composed of packages of rolls 12*a* identical to those just described, but only the lower package 10*a* is covered with a wrapping of shrinkable or stretchable material, while package 11*a* which is stacked on top (FIG. 9) lacks such a wrapping. However, the upper package 11*a* is subsequently covered with a wrapping 13*a* of shrinkable material, such as polyethylene for example, which covers it completely and whose lower skirt-like part surrounds the upper part of the lower package 10*a*. As previously indicated, the skirt of the wrapping 13*a* will preferably cover the lower package 10*a* to a height at least equal to the diameter of the rolls 12*a* (FIG. 10).

The shrink fit of the wrapping 13*a* is subsequently accomplished by introducing the stack of packages into a shrinkage oven 14*a* where it is heated by means of manifolds 15*a* emitting infrared radiation. The effect of the heat causes the wrapping to shrink, and to take the form of the upper package and shrink fit over the two packages in the region where they interface (FIG. 11).

As in the case of FIGS. 6, 7 and 8, a stack of two packages united as one is produced which can be moved and stored more easily.

As a matter of fact, this method of assembling two packages with one another eliminates sliding of the upper package on the lower package, thus facilitating stowing of the stack on transport carts or trucks.

Furthermore, the interface of the packages is protected from bad weather by the assembling means itself.

Similar stacks of superposed packages can be prepared by assembling them, and while they are slightly compressed, surrounding them with straps such as strips of plastic material.

It is possible to handle the stack of packages simply by suspending the upper package from which the lower package is now suspended by the assembling means. The user may thus move the stack of packages by means of a fork lift truck by introducing the prongs of the fork in the lower fork receiving recesses provided in the upper package. This frequently simplifies the handling of stacks of multiple roll packages.

Obviously, as long as the stack of packages is not ready for use, it should be handled with care to avoid damaging, on the one hand, the wrapping with which one or both packages are covered prior to their assembly and, on the other hand, the assembling means (belt or wrapping) which binds them together. The use of fork lift trucks should be avoided in certain cases since the fork would perforate both the wrappings and the assembling means. This is not a problem, however, since as can be seen from FIG. 12, all that is needed to transport a stack 16*a* of packages is a transport cart provided, in a manner known per se, with plates 18*a* that move sideways with respect to one another, laterally squeeze the stack, thereby providing for lifting and moving the stack safely without damaging any of its component parts.

The stacks of packages as disclosed can themselves be assembled into still larger units by means of horizontal or vertical straps for long distance transportation or hanger storage, for example.

Figure 13:
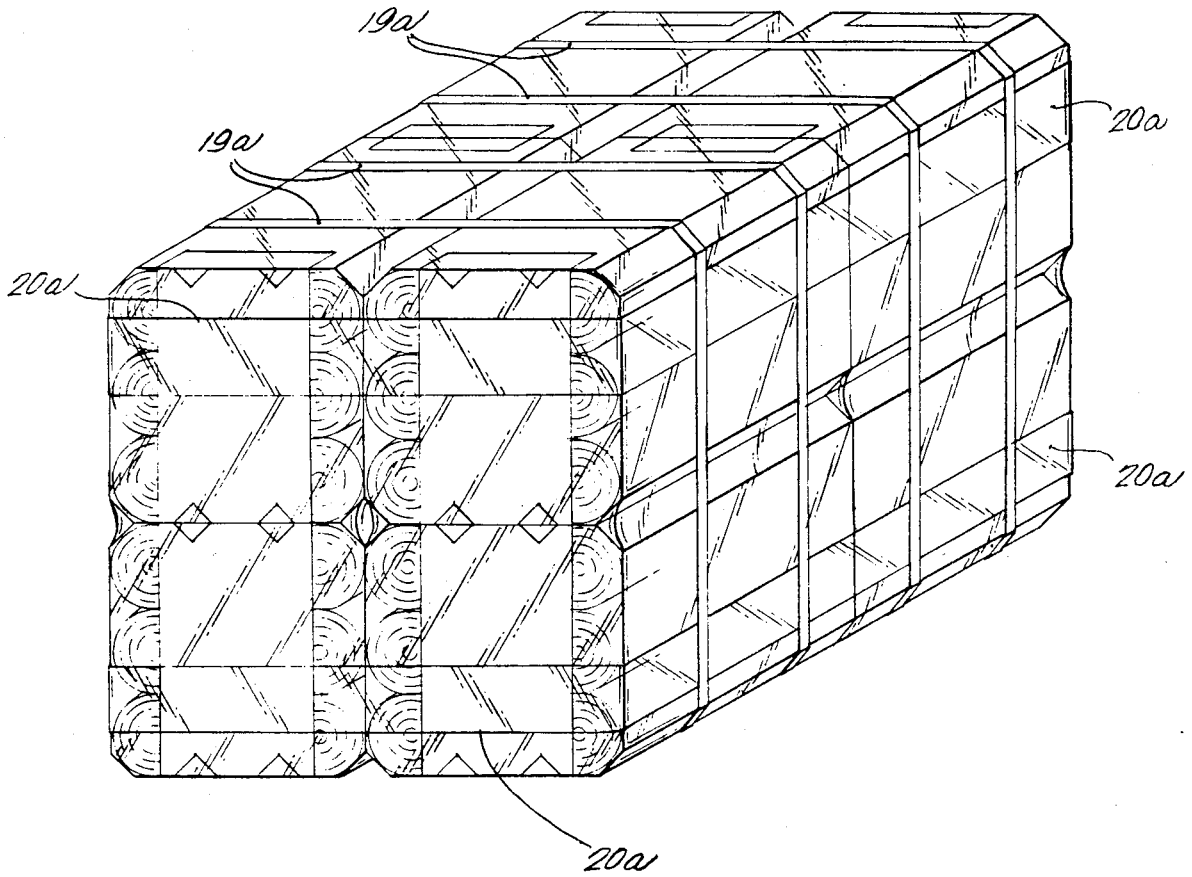
FIG. 13 shows a strap assembly adapted for use with four stacks of two packages, each ready to be transported by car, for example.

For this purpose, as shown in FIG. 13, it is possible to assemble two-package stacks by using straps of vertical strips 19*a* of plastic, such as polypropylene for example, analagous to those shown in FIGS. 1 and 2, to bind the rolls of each package perpendicularly to their axis. It is preferable that the strips 19*a* be placed over the strips of the individual packages in order to cover these.

The strips 19*a* prevent sliding of the various stacks with respect to one another and, therefore, facilitate storage and long distance transportation of these stacks. To bind the stacks with the strips, it is possible to use the same technique as described for binding the rolls of the packages, i.e., slightly compress the stacks before binding them, then relax the compression. In the case of FIG. 13, the two-package stacks are also assembled by means of a horizontal binding consisting of belts 20*a* of shrinkable plastic material applied as defined in the process of the present invention. One such belt is shown toward the top of the multiple stack in FIG. 13 and another such belt is shown toward the bottom of FIG. 13.

As shown in FIG. 13, the applicant has thus provided for preparation of units of four two-package stacks, each package containing nine rolls of glass wool with the following characteristics:

diameter of the rolls: 500–550 mm
length: 1600 mm
width: (length of the rolls): 1200 mm
height: 1280 mm
weight: 145 kg.

Such units of 72 rolls have the advantage of being very compact in this form which facilitates stowing in railroad cars and reduces dead storage space.

From the above, it will be seen that the invention provides a stack of at least two packages of rolls or parcels, each incorporating a plurality of rolls, these packages being stacked and at least one being provided with an external wrapping of stretchable or shrinkable plastic material, characterized in that an assembling means of shrinkable plastic material is provided, at least one part of which laterally hugs the upper part of the lower package and the lower part of the upper package, and in that said assembling means is shrunk on the external part of said packages with which it comes into contact.

It is preferred that the assembling means hug each of the two packages over a distance at least equal to the diameter of the individual rolls of which the packages are made up.

Stacks of packages according to the invention are prepared by a method that is simple and easy to implement. The packages are stacked by placing a package with a wrapping at the bottom of a pile, the assembling means of shrinkable plastic material then being placed around the packages in such a way as to laterally cover the upper part of the lower package and the lower part of the upper package, and said means is then brought to a temperature such that it binds said packages by shrink fit.

In the case where only the lower package has a wrapping of shrinkable or stretchable material and where the assembling means consists of a wrapping which covers the upper package and whose lower part forms a skirt which surrounds the upper part of the lower package, the assembly wrapping may be brought to the desired shrinkage temperature by passage through an oven.

From various parts of the detailed description given above and from examination of the drawings accompanying this application, it will be seen that the present invention provides a method for integrating a multiplicity of rolls of compressible material into a unitarily handleable assembly. The method comprises several major aspects and stages including preliminary assembly of a plurality of rolls of compressible material in groups, the rolls of each group being assembled in at least two layers superimposed upon each other and each comprising a plurality of rolls, with the axes of individual rolls of each layer overlying the axes of individual rolls of adjoining layers. These groups of rolls are then subjected to pressure in order to partially compress the rolls; ad in this condition, bindings are applied to each group in order to form integrated multiple roll packages. After relief of the pressure, a plurality of the packages may be assembled in a stack, and bindings are applied to the stack, the bindings comprising shrinkable plastic sheet material at least a portion of which bridges and is shrunk onto adjoining exposed surfaces of stacked packages. Still further, provision is made for assembly of a plurality of such stacks of packages in side-by-side relation, and the application of bindings in the form of belts surrounding the assembled stacks.

Various of these features are of great importance from many standpoints in the fabrication and handling of such materials. Thus, by the initial assembly of the multiple roll packages, these packages may be handled, stored or transported as such, or they may alternatively be brought together in stacks and the stacks, in turn, may be brought together into groups of stacks, so that larger total quantities of rolls may readily be handled as a unit, either for storage or transport. The flexibility of this system is of great importance not only in the manufacturing operation, but also in connection with the ultimate shipment and handling of the rolls at a point of use.

It will also be observed that even where coverings and bindings are applied to assembled packages, the accessibility of the recesses for the fork elements of a fork lift is always maintained. Sheet coverings can readily be penetrated by the fork elements, and bindings can readily be applied in areas which will not interfere with the action of a fork lift.

I claim:

1. A method for integrating a multiplicity of rolls of compressible material into a unitarily handleable multiple stack, which method comprises assembling a plurality of rolls in groups, the rolls of each group being substantially the same length and being assembled with a plurality of rolls in each of at least two layers superposed upon each other, with the axes of individual rolls of each layer overlying the axes of individual rolls of adjoining layers in common vertical planes and the rolls overlying each other being in contact with each other, assembling each multilayer group of rolls between a pair of contoured panels having grooves in which the adjoining opposite side portions of the assembly of rolls are received, establishing predetermined package dimensions in both directions transverse to the axes of the rolls by partially compressing the assembly of rolls between said contoured panels while restraining lateral spreading of the assembly of rolls between assembly forming walls having predetermined lateral dimension of the assembly, applying bindings to the assembled and partially compressed rolls of each group to form separate integrated multiple roll packages of predetermined dimensions in both directions transverse to the axes of the rolls, releasing the pressure after application of the binding, assembling a plurality of said packages in a stack with the package side surfaces in common planes at both sides of stack, and applying bindings to said stack, the stack bindings comprising shrinkable plastic sheet material, at least a portion of which bridges and is shrunk onto adjoining laterally exposed surfaces in said common planes at the sides of the stacked packages.

2. A method for integrating a multiplicity of rolls of compressible material into a unitarily handleable assembly, which method comprises assembling a plurality of rolls in groups each comprising a plurality of layers with a plurality of rolls in each layer, the rolls of each layer being in lateral contact with each other and the rolls of the layers having their axes superimposed in vertical planes and being in superimposed contact with each other, establishing predetermined package dimensions in both directions transverse to the axes of the rolls by partially compressing the assembled rolls of each group in one lateral direction while restraining spreading of said assembled rolls in another lateral direction, applying bindings to the assembled and compressed rolls of each group to form separate multiple roll packages each having the same lateral dimensions, assembling a plurality of said packages in a stack with lateral side surfaces of the rolls in common planes at the sides of the stack packages, and applying bindings to said stack, the stack bindings comprising heat shrinkable plastic sheet material, at least a portion of which bridges and is heat shrunk onto adjoining laterally exposed surfaces in said common planes at the sides of the stacked packages.

3. A method as defined in claim 2, in which a plurality of stacks of multiple roll packages are assembled in side-by-side relation and in which binding is also applied in the form of a belt around the assembled stacks.

4. A method for integrating a multiplicity of generally cylindrical rolls of compressible material into a unitarily handleable assembly, which method comprises partially compressing multiple roll packages of said compressible rolls of compressible material, stacking at least two partially compressed multiple roll packages in superposed relation, said roll packages being of substantially the same lateral dimension, with laterally presented recesses adjoining and intervening between an upper roll of the lower package and a lower roll of the upper package, at least the lower of said roll packages having an external wrapping of heat shrinkable plastic sheet material, binding the packages together by placing heat shrinkable plastic sheet material around the assembly of stacked packages in position to laterally overlie the recesses between the upper part of the lower package and the lower part of the upper package, and heat shrinking plastic sheet material employed for binding the packages together and thereby cause the heat shrunk sheet material to conform to and engage surfaces of the packages adjoining said recesses.

5. A method as defined in claim 4 in which each of the stacked packages has an external wrapping of heat shrinkable plastic sheet material, and in which the binding of the two packages together is effected by applying a heat shrinkable belt around the stacked packages in the region of said laterally presented recesses, and heating said belt to effect shrinkage thereof into said recesses.

6. A method as defined in claim 4 in which only the lower of the stacked packages is provided with an external wrapping of heat shrinkable plastic sheet material, and in which the binding of the stacked packages is effected by applying shrinkable plastic sheet material completely covering the upper portions of the upper package and overlapping with the upper part of the lower package, and heating the binding plastic sheet material to effect shrinkage into the laterally presented recesses.

7. A method for integrating a multiplicity of rolls of compressible material into a unitarily handleable package, which method comprises assembling a plurality of rolls in a group, the rolls of the group being substantially the same length and being assembled with a plurality of rolls in each of at least two layers superposed upon each other, with the axes of individual rolls of each layer overlying the axes of individual rolls of adjoining layers in common vertical planes and the rolls overlying each other being in contact with each other, assembling the layers of rolls between a pair of contoured panels having grooves in which the adjoining opposite side portions of the assembly of rolls are received, establishing predetermined package dimensions in both directions transverse to the axes of the rolls by partially compressing the assembly of rolls between said contoured panels while restraining lateral spreading of the assembly of rolls between forming walls having the predetermined lateral dimension of the assembly, applying bindings to the assembled and partially compressed rolls of the group to form an integrated multiple roll package of predetermined dimensions in both directions transverse to the axes of the rolls and releasing the pressure after application of the bindings.

* * * * *